US012638259B2

(12) United States Patent
Griffitts

(10) Patent No.: US 12,638,259 B2
(45) Date of Patent: May 26, 2026

(54) MULTIPLE CALIBER SOUND SUPPRESSOR WITH ADAPTER FOR USE WITH MUZZLE ACCESSORY

(71) Applicant: James Norman Griffitts, Maryville, TN (US)

(72) Inventor: James Norman Griffitts, Maryville, TN (US)

( * ) Notice: Subject to any disclaimer, the term of this patent is extended or adjusted under 35 U.S.C. 154(b) by 0 days.

(21) Appl. No.: 18/133,692

(22) Filed: Apr. 12, 2023

(65) Prior Publication Data

US 2023/0358495 A1 Nov. 9, 2023

Related U.S. Application Data

(63) Continuation-in-part of application No. 17/670,625, filed on Feb. 14, 2022, now Pat. No. 12,163,750.

(60) Provisional application No. 63/148,679, filed on Feb. 12, 2021.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325; F41A 21/34; F41A 21/36; F41A 21/38
See application file for complete search history.

(56) References Cited

U.S. PATENT DOCUMENTS

| | | | |
|---|---|---|---|
| 618,901 | A | 2/1899 | Peterson |
| 785,974 | A | 3/1905 | Mcclean |
| 817,134 | A | 4/1906 | Smith |
| 1,174,165 | A | 3/1916 | Charles |
| 1,333,402 | A | 3/1920 | Andre et al. |
| 1,363,058 | A | 12/1920 | Shanahn |
| 1,429,619 | A | 9/1922 | Nelson |
| 1,502,558 | A | 7/1924 | Galliot |
| 1,605,393 | A | 11/1926 | Cutts, Jr. |
| 1,901,138 | A | 3/1933 | Barnes |
| 1,948,496 | A | 2/1934 | Barnes |
| 2,143,596 | A | 1/1939 | Andre et al. |
| 2,184,301 | A | 12/1939 | Hughes |

(Continued)

FOREIGN PATENT DOCUMENTS

| | | | |
|---|---|---|---|
| FR | 656608 | A | 5/1929 |
| FR | 815441 | A | 7/1937 |

(Continued)

OTHER PUBLICATIONS

The Firing Line Forums. <https://thefiringline.com/forums/showthread.php?t=468059>. Nov. 18, 2011. (Year: 2011).*

(Continued)

*Primary Examiner* — Gabriel J. Klein
(74) *Attorney, Agent, or Firm* — Blanchard Horton PLLC

(57) ABSTRACT

A system for installing a first muzzle accessory on a barrel of a firearm having a second muzzle accessory mounted thereto comprises an adapter configured to attach to the second muzzle accessory and a first muzzle accessory configured to attach to the adapter. The adapter serves to temporarily deactivate the second muzzle accessory when the adapter is attached to the second muzzle accessory.

15 Claims, 6 Drawing Sheets

(56) References Cited

U.S. PATENT DOCUMENTS 2,192,081 A 2/1940 Hughes
2,212,684 A 8/1940 Hughes
2,212,685 A 8/1940 Hughes
2,223,014 A 11/1940 Andre et al.
2,322,370 A 6/1943 Lance
2,351,037 A 6/1944 Green
2,403,007 A 7/1946 Maris
2,451,514 A 10/1948 Sieg
2,453,121 A 11/1948 Cutts
2,667,815 A 2/1954 Strong
2,742,821 A 4/1956 Sweetman
2,765,706 A 10/1956 Strohl
2,842,024 A 7/1958 Mutter
2,899,866 A 8/1959 Clark et al.
3,141,376 A 7/1964 Chinn
3,202,056 A 8/1965 Kurt
3,368,453 A 2/1968 Shaw
3,478,841 A * 11/1969 Siegfried ..... F41A 21/30 89/14.4
3,492,912 A 2/1970 Ashbrook
4,024,791 A 5/1977 Stratman
4,307,652 A 12/1981 Witt et al.
4,510,843 A * 4/1985 Rabatin ..... F41A 21/325 89/14.4
4,545,285 A 10/1985 McLain
D285,238 S 8/1986 Cellini
4,691,614 A 9/1987 Leffel et al.
4,852,460 A 8/1989 Davidson
4,879,942 A 11/1989 Cave
4,930,397 A 6/1990 Seidler
4,945,812 A 8/1990 Mazzanti
5,036,747 A 8/1991 McClain, III
5,063,827 A 11/1991 Williamson
D343,222 S 1/1994 Morales
5,279,200 A 1/1994 Rose
5,320,022 A 6/1994 Kimbro et al.
5,333,529 A 8/1994 Brockman
5,357,842 A 10/1994 Reynolds
5,423,242 A 6/1995 Schuemann
5,425,298 A 6/1995 Coburn
5,476,028 A 12/1995 Seberger
5,675,107 A 10/1997 Ledys et al.
5,685,102 A 11/1997 Latka
5,773,746 A * 6/1998 Vaden ..... F41A 21/325 89/14.4
5,844,162 A 12/1998 Renner
6,385,891 B1 5/2002 Rabatin
6,516,698 B1 2/2003 Poff, Jr.
7,032,339 B1 4/2006 Bounds
7,600,461 B1 10/2009 Cler et al.
7,954,414 B2 6/2011 Dueck et al.
8,087,337 B1 1/2012 Cary
8,250,962 B1 8/2012 Guenther et al.
8,291,805 B1 * 10/2012 Quilligan ..... F41A 21/325 285/305
8,490,535 B1 * 7/2013 Moore ..... F41A 21/34 42/1.06
8,627,755 B1 1/2014 Eckel
8,695,475 B2 4/2014 Schneider
8,939,057 B1 1/2015 Edsall
9,163,891 B1 10/2015 Dater et al.
9,182,187 B1 11/2015 Griffith
9,207,034 B2 12/2015 Larson, Jr.
9,885,533 B2 2/2018 Griffitts
9,921,021 B1 3/2018 Graham, II
10,126,085 B2 11/2018 Deros
10,156,411 B2 12/2018 Thompson et al.
10,197,351 B2 2/2019 Griffitts
10,422,603 B2 9/2019 Griffitts
10,520,272 B1 12/2019 Carson et al.
10,670,362 B2 6/2020 Wilson
10,816,300 B2 10/2020 Griffitts
10,883,787 B2 1/2021 Palu et al.
11,209,233 B1 12/2021 Oglesby
11,506,463 B1 * 11/2022 Kunsky ..... F41A 21/30
11,644,265 B1 5/2023 Oglesby
2002/0117048 A1 8/2002 Sevastian
2004/0244571 A1 12/2004 Bender
2007/0095198 A1 * 5/2007 Dater ..... F41A 21/325 89/14.3
2008/0098880 A1 5/2008 Brugger
2011/0154711 A1 6/2011 Dickerson et al.
2011/0226121 A1 9/2011 Peterson et al.
2011/0271575 A1 * 11/2011 Overbeek Bloem ... F41A 21/34 42/90
2012/0180623 A1 7/2012 Graham, II et al.
2012/0246987 A1 10/2012 Anthony
2013/0227871 A1 9/2013 Stone
2013/0233162 A1 9/2013 Schneider
2014/0020976 A1 1/2014 Shults
2014/0165438 A1 6/2014 Wilkinson
2014/0237881 A1 8/2014 Mack
2014/0299405 A1 * 10/2014 Miller ..... F41A 21/30 181/223
2015/0192379 A1 7/2015 Larson et al.
2015/0308778 A1 10/2015 Vossler
2016/0018177 A1 * 1/2016 Powell ..... F41A 21/30 89/14.4
2016/0097609 A1 4/2016 Penchuk
2016/0209153 A1 7/2016 Dueck et al.
2016/0334181 A1 11/2016 Bennington et al.
2017/0059268 A1 3/2017 Sherrill
2017/0191782 A1 7/2017 Bray
2017/0261282 A1 9/2017 Griffitts
2017/0299316 A1 10/2017 Vossler
2017/0343311 A1 11/2017 Deros
2018/0135933 A1 5/2018 Griffitts
2018/0245873 A1 8/2018 Griffitts
2018/0340750 A1 * 11/2018 Mooty ..... F41A 21/34
2018/0347931 A1 * 12/2018 Schoppman ..... F41A 21/36
2019/0154387 A1 5/2019 Lee
2019/0195589 A1 6/2019 Lee
2019/0339036 A1 * 11/2019 Edminster ..... F41A 21/30
2019/0353446 A1 11/2019 Kras
2020/0284540 A1 * 9/2020 Doerr ..... F41A 21/30
2021/0164748 A1 6/2021 Griffitts
2021/0348869 A1 * 11/2021 Kmetz ..... F41A 21/325
2022/0057161 A1 * 2/2022 Johnston ..... F41A 21/34
2022/0333890 A1 * 10/2022 Griffitts ..... F41A 21/325
2023/0003478 A1 * 1/2023 Noonan ..... F41A 21/30
2023/0138685 A1 5/2023 Wilson

FOREIGN PATENT DOCUMENTS

GB 479107 A 1/1938
GB 499092 A 1/1939

OTHER PUBLICATIONS

"International Search Report and Written Opinion received for PCT Patent Application No. PCT/US2018/018319, mailed on Apr. 30, 2018", 5 Pages.
"International Search Report and Written Opinion received for PCT Patent Application No. PCT/US2020/050946, mailed on Jan. 21, 2021", 7 Pages.

* cited by examiner

MULTIPLE CALIBER SOUND SUPPRESSOR WITH ADAPTER FOR USE WITH MUZZLE ACCESSORY

CROSS-REFERENCE TO RELATED APPLICATIONS

This application claims priority to U.S. patent application Ser. No. 17/670,625, filed on Feb. 14, 2022, which in turn claims priority to U.S. Provisional Patent Application No. 63/148,679, filed on Feb. 12, 2021. Each of the aforementioned applications is incorporated herein in its entirety by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to firearms, and, more particularly, to sound suppressors, of the type designed to muffle or reduce sound and to capture and suppress barrel flash produced by the discharge of a firearm, along with other accessories for the muzzle end of a firearm barrel, such as for example muzzle brakes of the type designed to control firearm recoil, barrel lift, and lateral deflection of firearms during and after discharge.

2. Description of the Related Art

Firearms utilizing a barrel design, such as for example cannons, muskets, rifles, handguns, and the like (hereinafter, collectively, "firearms") date back many centuries. In general, most firearms operate by propelling a projectile along the length of a barrel from a "breech" end thereof until the projectile exits a "muzzle" end of the barrel by controlling and focusing the energy of gases produced by rapidly burning a propellant, such as for example gun powder, in a chamber within the barrel behind the projectile. These firearms are capable of propelling projectiles a great distance at a high velocity in a desired direction. However, at least three principal negative effects typically occur as a result of discharging a typical firearm.

First, it is noted that, according to Newton's Third Law of Motion, also known as the law of Action and Reaction, when a body is imparted with a given momentum in a given direction, some other body or bodies are imparted with an equal momentum in the opposite direction. As applied to firearms, firing a projectile from the barrel of a firearm, away from the firearm user, results in a shock force exerted by the firearm over a very short time duration in the opposite direction, that is, in the direction of the firearm user. This shock force is commonly referred to as "recoil," or sometimes as "kick back," or "kick." The recoil, or rapid acceleration of the firearm toward the breech end of the firearm barrel by firing a projectile, imparts energy to the individual or mechanism holding the firearm and can be mild to severe. In some cases, such recoil may be devastating to the individual or mechanism holding the firearm, depending on the amount of energy involved, the mass and velocity of the propellant, the mass and velocity of the atmosphere in front of the projectile, the mass and velocity of the projectile, the mass of the firearm, and the duration through which the recoil is imparted. Over time, the shock force generated by firearm recoil may have a detrimental effect on the firearm itself and any optics or other sighting systems used on the firearm. Also, over time, the shock force generated by firearm recoil may impact any mechanism or mounting points holding the firearm itself. This can be detrimental, for example, when a firearm is mounted for use in aircraft, mobile vehicles, field mounted equipment, or navel equipment. Recoil may also contribute directly to reduced control of the firearm by the user. Movement of the firearm due to uncontrolled or poorly controlled recoil may, for example, require repositioning of the firearm and reacquisition of an intended target before another projectile can be accurately fired.

A second negative effect which frequently occurs as a result of discharging a firearm is the production of excess noise. The rapid burning of gun powder or other propellant by the firearm, together with the rapid discharge of the projectile from the muzzle end of the barrel, ordinarily results in a loud and sudden shockwave, often referred to as a "report," a "gunshot," or a "blast." Depending on the specific firearm discharged and such factors as the type of ammunition used and the environmental factors surrounding the event, this shockwave can exhibit significant volume and acoustic intensity. For many firearm designs, it is necessary for a user to wear hearing protective equipment, such as earmuffs or earplugs, to dampen or muffle the sound of the firearm's report in order to avoid damage to the user's hearing. Furthermore, the loud volume and acoustic intensity of a firearm report may be so great that it can be heard from a significant distance surrounding the firearm and user. This can be highly undesirable, for example, in situations involving hunting or combat using a firearm, in which the firearm user may wish to avoid alerting other animals or people nearby of the presence and location of the firearm user or of the fact that a firearm has been discharged. Excessive noise due to firearm report may also be detrimental, for example, in situations in which a firearm is being discharged near a populated area, in which the loud noise from the firearm discharge may disturb other people or animals nearby.

A third negative effect which frequently occurs as a result of discharging a firearm is the production of firearm "flash." Firearm flash occurs when combusting propellant from a discharging firearm exits the firearm barrel or otherwise becomes visible from the exterior of the firearm barrel. This typically results in a flash of light and is often produced from the muzzle end of a firearm barrel. Again, in situations involving hunting or combat using a firearm, this flash of light may be detrimental to the firearm user, for example, by unwantedly alerting other animals or people to the presence and location of the firearm user. Firearm flash may also disturb other people or animals, for example in situations in which the firearm is being discharged near a populated area.

For the above reasons, numerous devices have been developed which may be attached to, or formed into, the muzzle end of a firearm to assist in reducing or controlling one or more of the above-described negative effects. As used herein, such devices may be referred to as "muzzle accessories." For example, one muzzle accessory that is generally known in the art is a firearm sound suppressor. A sound suppressor, often referred to as a "silencer," "suppressor," or "sound moderator," is a muzzle accessory that reduces the acoustic intensity of the firearm report and may, in certain designs, also reduce the recoil of the firearm when the firearm is discharged by modulating the speed and pressure of the propellant gas from the muzzle, hence "suppressing" the report. Typical sound suppressors consist of a hollow metallic cylinder containing a series of annular internal sound baffles, with a hollow bore along a central axis of the cylinder to allow the projectile to pass through the cylinder along the central axis and exit the sound suppressor with little-to-no directional change. During firing, the projectile travels through the bore along the central axis of the suppressor with little hindrance, but most of the expanding gas ejecta behind it is retained through a longer and convoluted escape path created by the baffles, prolonging the release time. This slows down the gas and dissipates its kinetic energy into a larger surface area, reducing the acoustic intensity of the report, and thus lowering the "loudness" of the gunshot. Because the internal baffles slow and "cool down" the released gas, many designs of sound suppressors may also reduce or eliminate muzzle flash.

Another type of muzzle accessory generally known in the art is a flash suppressor. Flash suppressors may, in various designs, reduce the amount of flash exhibited by a firearm by dispersing burning gases that are already released outside the muzzle, without necessarily any sound or recoil reduction. Typical flash suppressor designs may include, for example, a metallic hollow cylinder defining a plurality of through openings along the curved external sidewall thereof. During firing, the projectile is allowed to pass from the muzzle of the firearm through the cylinder along its central axis and exit the cylinder, again with little directional change. However, most of the expanding gas ejecta behind it is dispersed through the multiple vent openings along the sidewall of the flash suppressor. Thus, the escaping gas is dispersed, thereby reducing the amount or intensity of the flash.

A third type of muzzle accessory generally known in the art is a muzzle brake. A muzzle brake, sometimes referred to as a "recoil compensator" or "recoil suppressor," is a device connected to, or a feature integral with, the muzzle of a firearm that is intended to redirect a portion of propellant gases to counter recoil of the firearm during firing. Various designs for muzzle brakes are known in the art, and many such designs differ greatly from one another in specific shape or configuration. However, generally, a muzzle brake consists of a hollow chamber mounted to the muzzle end of a firearm barrel, with a through bore defined therein to allow a projectile to pass through the chamber and to continue along its path with little directional change. The chamber of the muzzle brake further defines one or more openings, baffles, or shapes that are configured to at least partially divert combustion gases from the muzzle end of the bore, at a generally perpendicular angle to the long axis of the barrel, to counteract the forces of recoil on the firearm during firing. When a muzzle brake is formed integrally with a barrel of a firearm, the firearm barrel is often said to be "ported."

Several prior art designs of firearm muzzle brakes are shown and described in U.S. Pat. No. 9,885,533, issued to Griffitts, as well as its progeny, U.S. Pat. Nos. 10,197,351; 10,422,603; and 10,816,300; and U.S. patent application Ser. No. 17/022,255. In each of these devices (collectively referred to as the "Griffitts muzzle brakes"), a hollow cylindrical chamber is provided which is configured to be fixed to a muzzle end of a firearm with a central axis of the cylindrical chamber positioned coaxial with the long axis of the barrel. Each of the devices of the Griffitts muzzle brakes includes, generally, a plurality of openings or "vent ports" defined along the curved side wall of the cylindrical chamber. The vent ports are shaped such that, among other functions that are described more fully in the Griffitts references, the vent ports cooperate to capture and redirect a portion of propellant gases exiting the muzzle in order to counteract the forces of recoil on the firearm during firing.

Several prior art designs for muzzle accessories are adapted to assist in reducing one or two of the negative effects of discharging a firearm (recoil, noise, or flash), without addressing the remaining negative effects. For example, the devices of the Griffitts muzzle brakes are each adapted to significantly reduce firearm recoil and may in certain applications reduce or alter somewhat the flash produced by a firearm. However, such devices do little, if anything, to reduce or control noise generated by a firearm report. For this reason, it is often desirable to switch between use of different muzzle accessories on a firearm in order to assist in reducing different ones of the above-discussed negative effects of discharging a firearm, or different combinations of negative effects. For example, a user of a firearm employing a muzzle brake to reduce and control recoil may wish to quickly and temporarily remove the muzzle brake from the firearm muzzle and replace it with a sound suppressor to assist in controlling noise from firearm report. Likewise, a user of a firearm employing a sound suppressor to control report noise may wish to quickly and temporarily remove the suppressor from the firearm muzzle and replace it with a muzzle brake to assist in reducing and controlling recoil, for example to improve the speed and accuracy of repeat shots using the firearm.

In situations such as those described above, a significant limitation exists in the design of numerous prior art muzzle accessories, in that the muzzle accessory must be at least semi-permanently secured to the muzzle end of the firearm barrel. For example, in most muzzle brake designs, the cylindrical chamber is formed with threads at one end of the through bore which are adapted to be threadably received onto an externally-threaded portion of the firearm barrel and either thoroughly tightened thereto or fixed in position by way of a set screw or other fastener. In such configurations, removal and reattachment of the muzzle brake device is cumbersome and time consuming, requiring the careful use of tools in loosening any fasteners and unthreading the device to remove the device, and requiring careful rethreading and rotational alignment of the device in relation to the barrel in order to reattach the device. This is not ideal in several situations, such as for example in situations involving hunting or combat in which speed of deployment of the firearm may be critical.

In view of the above, there is a need in the art for a device which will allow a user of a firearm to quickly and conveniently switch from one muzzle accessory to another. For example, there is a need in the art for a device which will allow a user of a firearm to quickly and conveniently switch from the use of a muzzle brake or other muzzle accessory with the firearm to a sound suppressor, and to then to quickly and conveniently return to using the original muzzle accessory with the firearm, absent the need to remove the original muzzle accessory from the firearm.

An additional need in the art exists for a muzzle accessory which may be used in connection with numerous different calibers of firearms. For example, in the case of sound suppressors, numerous prior art sound suppressors exist which are generally designed for use in connection with a firearm of a specific caliber. In this regard, most prior art sound suppressors are constructed with a hollow bore extending along the central axis of the cylinder and along the various baffles of the suppressor, and in which the hollow bore is sized to closely conform to the outer diameter of a specific caliber of bullet with which the sound suppressor is designed to be used. The sound suppressor may function properly when used with the correct caliber. However, firing a bullet through the sound suppressor that is of a smaller caliber than is intended for use with the sound suppressor may result in little to no suppression of the report or flash of the firearm. Moreover, firing a bullet through the sound suppressor that is of a larger caliber than is intended for use with the sound suppressor almost inevitably results in catastrophic damage to the various baffles and cylinder of the sound suppressor as the larger bullet tears through the various components of the sound suppressor forming the smaller hollow bore.

Significant limitations exist in prior art sound suppressor designs, in that the sound suppressors cannot easily be made to accommodate alternate calibers of firearms from the original caliber for which the sound suppressor is designed. For example, in most sound suppressor designs, in order to reconfigure the sound suppressor to be used in connection with a different caliber of firearm other than the caliber originally intended for use, the sound suppressor must be reconfigured to exhibit a different sized hollow bore along the central axis. This can be done, for example, by cutting a new, wider bore along the central axis through the various components of the sound suppressor to accommodate a wider caliber bullet, or by replacing the various internal and external components of the sound suppressor forming the bore, i.e., the baffles and at least a front surface of the cylinder, with alternate matching components that cooperate to define either a wider or a narrower through bore. Similar to the above-discussed situations in which a user may wish to quickly switch between various types of muzzle accessories on a single firearm, users who wish to employ a single sound suppressor, or other muzzle accessory, on multiple firearms of different calibers may not be able to quickly or readily alter the caliber of the hollow bore extending along the central axis of the sound suppressor.

In light of the above, there is a need in the art for a muzzle accessory device which can allow a user of a firearm to quickly and conveniently switch between using the muzzle accessory device on the firearm and using a second muzzle accessory on the firearm. There is a further need in the art for a muzzle accessory device, and in particular a sound suppressor, which can allow a user of a firearm to quickly and conveniently switch from using the muzzle accessory on a first firearm of a first caliber to using the same muzzle accessory on a second firearm of a second caliber, absent the need for slow and cumbersome repairs and/or reconfigurations of the muzzle accessory.

BRIEF SUMMARY OF THE INVENTION

According to various example embodiments of the present general inventive concept, a system is provided for installing a first muzzle accessory, such as a sound suppressor or other muzzle accessory, on a barrel of a firearm that has a prior muzzle accessory mounted thereto. Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a system for installing a sound suppressor on a barrel of a firearm, in which the firearm may have a muzzle accessory mounted thereto, and in which the system includes an adapter configured to attach to the muzzle accessory and a sound suppressor configured to attach to the adapter. In various embodiments, the sound suppressor may include an outer housing having a generally cylindrical shape and an open forward end, and a plurality of forward walls removably securable to the forward end of the housing and interchangeable with one another, each of the forward walls defining a through bore positioned along the forward wall to align with a central axis of each of the muzzles of the firearms when the forward wall is secured to the housing, each through bore conforming to the caliber of one of the firearms.

In various embodiments, the system may further include a coupler configured to attach to the muzzle accessory, and the sound suppressor may be configured to attach to the coupler. In various embodiments, the adapter may be configured to limit air flow within the muzzle accessory between a projectile intake and a projectile outlet of the muzzle accessory, such that the muzzle accessory functions as an expansion chamber for gas exiting the muzzle. In various embodiments, the sound suppressor may comprise a single deflector, or multiple deflectors. In various embodiments, the deflector or deflectors may be integrally formed with a forward end wall of the sound suppressor. However, in various embodiments, the forward end wall of the sound suppressor, including the deflector or deflectors, may be removably secured to the remainder of the sound suppressor.

In various embodiments, the adapter may include a sleeve configured to surround at least a portion of the muzzle accessory. In various embodiments, the adapter may further include a chuck configured to allow the adapter to be fastened to the muzzle accessory when the muzzle accessory is received within the sleeve. In various embodiments, the chuck may include at least one cutout defined along the sleeve, and at least one movable segment member may be removably received within the at least one cutout. In various embodiments, the at least one movable segment member may define a surface configured to mate with and engage at least a portion of at least one feature of the muzzle accessory. In various embodiments, the at least one movable segment member may be rotatably secured to the at least one cutout. In various embodiments, the chuck may further comprise a fastener for securing the at least one movable segment member within the at least one cutout.

In various embodiments, the fastener may be a threaded fastener, and in various embodiments, the fastener may establish a threaded engagement with the at least one movable segment member and a frictional engagement with the sleeve.

In various embodiments, each forward wall may define a threaded outer surface adapted to threadably mate with an inner surface of the housing and at least one protuberance configured to be engaged for rotating the forward wall into and out of threadable engagement with the housing inner surface. Each protuberance may be defined by a removable bolt positioned along a forward surface of the forward wall. Each forward wall may further define a rearward surface configured to face an interior of the housing and defining an annular concave trough encircling the respective through bore of the forward wall. Each forward wall rearward surface may further define a truncated conical deflector portion annularly surrounding the through bore of the forward wall and extending between the through bore and the annular concave trough. The plurality of forward walls may include, for example, forward walls having through openings conforming to each of a plurality of calibers.

Other features and aspects may be apparent from the following detailed description, the drawings, and the claims.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Figure 1:
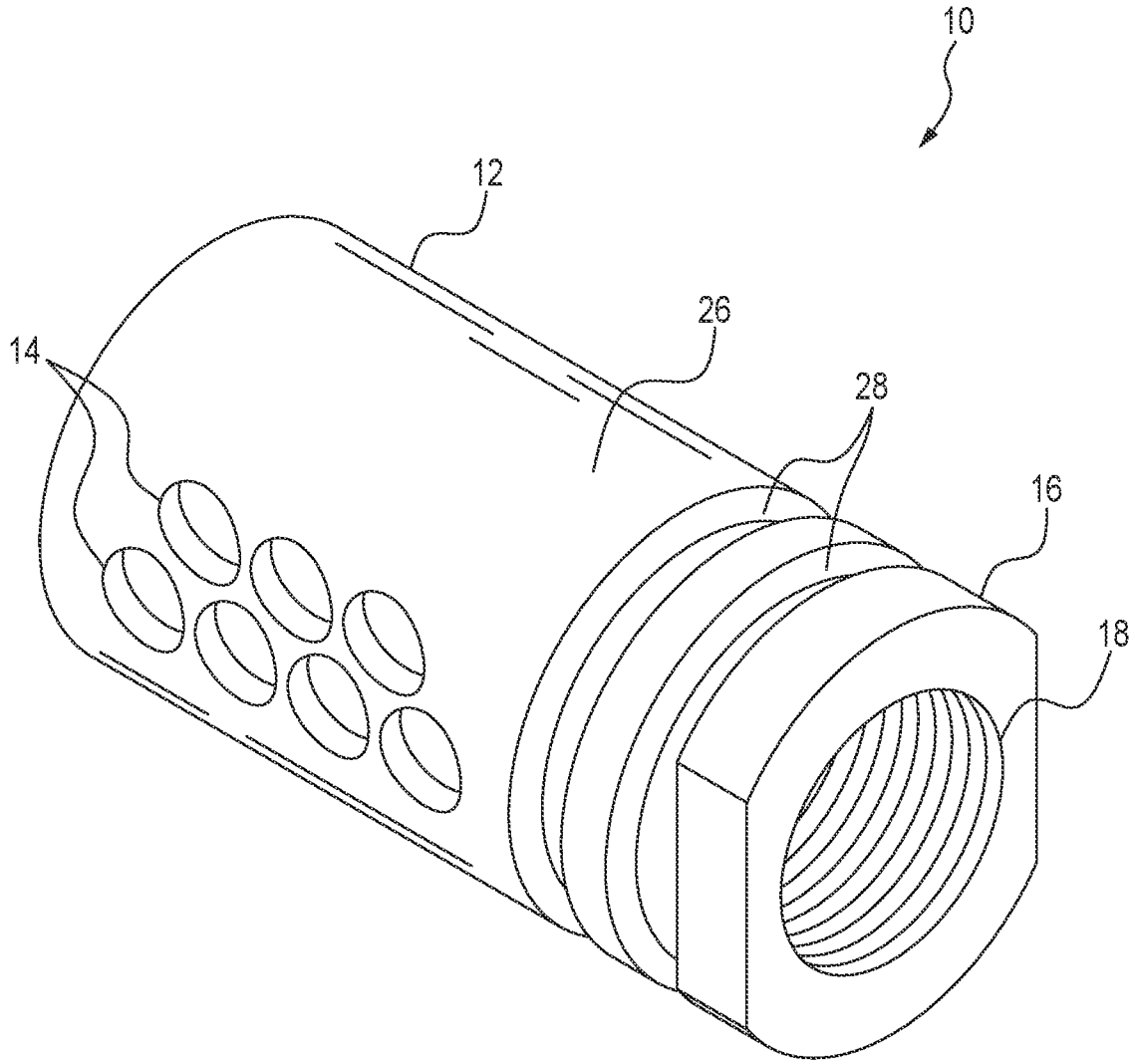
FIG. 1 is a perspective view of a muzzle brake of the type generally described in U.S. Pat. No. 10,422,603, issued to Griffitts.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various examples of the present general inventive concept, an adapter for use in securing a first muzzle accessory to a second muzzle accessory (hereinafter, an "adapter") is provided that may be produced in a number of configurations and installed along an outer surface of the second muzzle accessory. Various example embodiments of the present general inventive concept may provide an adapter that may be installed onto a second muzzle accessory which is itself installed on a muzzle end of a firearm barrel, or which may be installed onto a firearm barrel to at least partially surround a muzzle accessory, in order to allow the adapter to be used in connection with a first muzzle accessory, such as for example a sound suppressor to reduce and/or control noise associated with report of the firearm, while the second muzzle accessory remains installed on the muzzle end of a firearm barrel. Various example embodiments of the present general inventive concept may also provide a first muzzle accessory that may be uninstalled from the second muzzle accessory and/or firearm barrel in order to allow for discontinued use of the first muzzle accessory in connection with the firearm and continued use of the second muzzle accessory. Various example embodiments of the present general inventive concept may also provide a first muzzle accessory that may be configured to be installed on, and used with, a second muzzle accessory having a first caliber; wherein the first muzzle accessory may be reconfigured for installation on, and use with, one or more third muzzle accessories having one or more alternate calibers. Various example embodiments of the present general inventive concept may provide a first muzzle accessory, such as for example a sound suppressor, which may be quickly and conveniently reconfigured for use in connection with a variety of calibers absent the need for cumbersome retooling of the first muzzle accessory.

Figure 2:
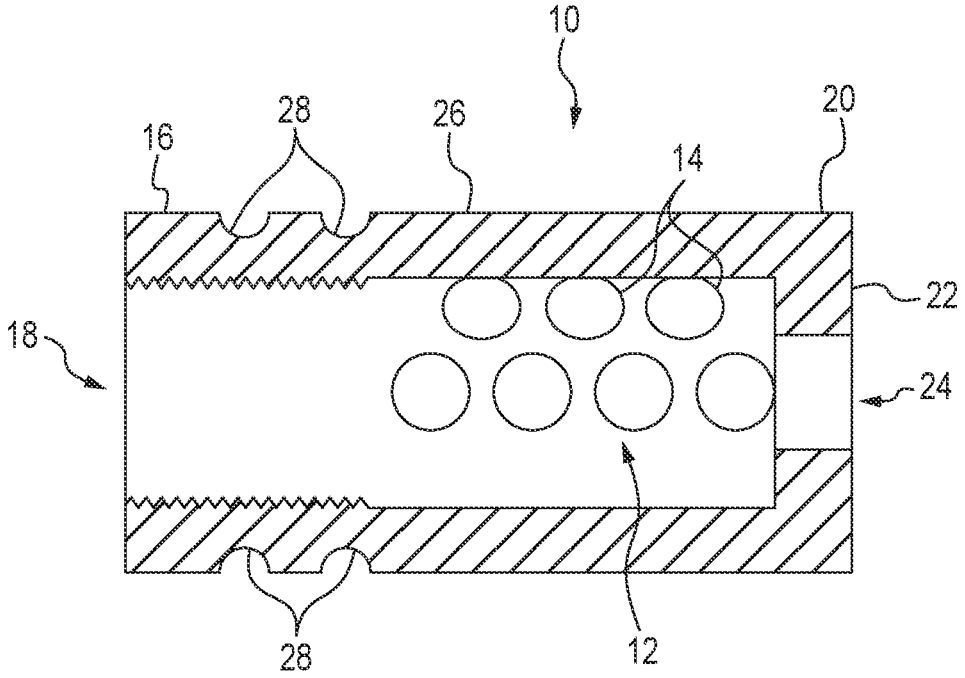
FIG. 2 is a cross-sectional side view of the muzzle brake of FIG. 1.

Various aspects of one example embodiment of an adapter constructed in accordance with several features of the present general inventive concept will be described herein in the context of a muzzle brake constructed in accordance with the above-discussed Griffitts muzzle brakes, one example of which is illustrated generally in FIGS. 1 and 2. More specifically, FIGS. 1 and 2 illustrate perspective and cross-sectional views, respectively, of a muzzle brake 10 of the type generally described in U.S. Pat. No. 10,422,603, issued to Griffitts. The illustrated muzzle brake 10 includes generally a substantially cylindrical gas capture chamber 12 defining a plurality of vent ports 14 arranged in rows extending along the longitudinal and axial centerline of the cylindrical gas capture chamber 12. A rearward end 16 of the gas capture chamber defines a through bore 18 extending from the interior of the gas capture chamber 12 and opening outwardly to a rear surface of the muzzle brake 10, the through bore extending coaxially with the centerline of the cylindrical gas capture chamber 12. The through bore defines inwardly-facing threads which are configured to be threadably received onto outward-facing threads of a muzzle portion of a firearm barrel. With reference to FIG. 2, a forward end 20 of the gas capture chamber defines a forward annular wall 22 extending perpendicularly inward from a forward edge of the curved cylindrical surface of the gas capture chamber 12. The forward annular wall 22 defines an additional through bore 24 which is sized to conform to, and is only slightly larger than, the caliber of a projectile to be fired from the muzzle of the firearm with which the muzzle brake 10 may be used. Similar to the through bore 18 of the rearward end 16 of the gas capture chamber 12, the through bore of the forward annular wall 22 extends coaxially with the centerline of the cylindrical gas capture chamber 12.

In the muzzle brake 10 illustrated in FIGS. 1 and 2, an outer surface 26 of the muzzle brake 10 defines a generally cylindrical shape. In accordance with various features of certain example embodiments constructed in accordance with the present general inventive concept, as will be discussed in further detail hereinbelow, the outer surface 26 of the muzzle brake 10 further defines at least one detent 28. In the illustrated muzzle brake 10, the at least one detent 28 includes a plurality of annular ridges extending about the curved outer surface 26 of the muzzle brake 10, rearward of the vent ports 14. In the illustrated embodiment, two such annular ridges are defined in parallel, spaced-apart configuration along the outer surface 26 to accomplish the at least one detent 28 and to define a ridge therebetween. However, it will be recognized that any number of a large variety of shapes and configurations may be employed to achieve the at least one detent 28 without departing from the spirit and scope of the present general inventive concept.

Figure 3:
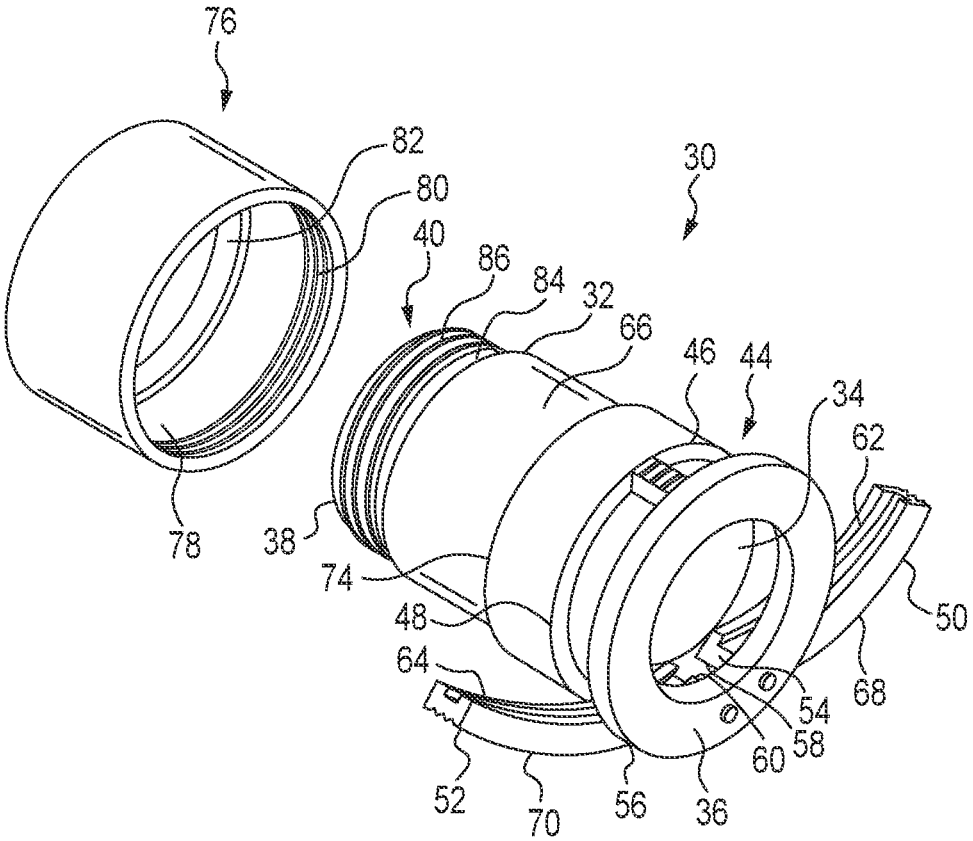
FIG. 3 is an exploded perspective view of one example embodiment of an adapter constructed in accordance with several features of the present general inventive concept.

FIG. 3 illustrates an exploded perspective view of one example embodiment of an adapter constructed in accordance with several features of the present general inventive concept. In this example embodiment, an adapter 30 is provided which is configured to be received and removably secured along the outer surface 26 of the muzzle brake 10. In this embodiment, the adapter 30 defines a generally hollow, cylindrical sleeve 32. The sleeve 32 defines a relatively smooth cylindrical inner surface 34 (FIG. 7) having an axial rearward end which opens to a rear wall 36 of the adapter 30. The inner surface 34 is sized to conform to, and to receive therein, at least the portion of the outer surface 26 of the muzzle brake 10 defining the vent ports 14 and the at least one detent 28, or a rearward facing feature of the muzzle device. In the illustrated embodiment, the inner surface 34 of the sleeve is sized to allow receipt of the muzzle brake 10 in mating conformity fully within the cylindrical sleeve 32, such that the rear wall 36 of the adapter 30 may be brought in parallel-planar relationship, flush with or rearward of, the rearward end 16 of the muzzle brake 10. In the illustrated embodiment, a forward end 38 of the sleeve 32 defines a through bore 40 which is slightly smaller than, and extends coaxially with, the cylindrical inner surface 34. Thus, the forward end 38 of the sleeve 32 defines an axially-inwardly facing lip 42 (FIG. 7) which is sized to surround a forward edge of the muzzle brake 10 and to limit further movement of the muzzle brake 10 in a forward direction in relation to the sleeve 32, once the muzzle brake 10 is fully received within the inner surface 34 with the rear wall 36 of the adapter 30 flush with or rearward of the rearward end 16 of the muzzle brake 10. Thus, the inner lip 42 serves as an inwardly-projecting annular "stop" to assist in positioning the muzzle brake 10 within the inner surface 34.

It will be recognized that numerous shapes and configurations may be employed to accomplish the above-discussed stop to assist in positioning the muzzle brake 10 within the inner surface 34 of the sleeve 32 without departing from the spirit and scope of the present general inventive concept. For example, in various embodiments, the through bore defined by the forward end of the sleeve may be of equal or greater diameter than the cylindrical inner surface. In such embodiments, one or more stops may be formed comprising an inwardly-projecting protrusion, knob, tab, or the like. In other embodiments, the sleeve may be provided absent any stops. For example, in one example embodiment, the sleeve may be approximately the same length as the muzzle brake 10, such that the cylindrical inner surface of the sleeve opens fully to both a rear wall and a forward end of the sleeve. In such embodiments, the muzzle brake 10 may be received within the inner surface of the sleeve such that the rear wall of the adapter is flush with the rearward surface of the muzzle brake 10 and a forward end of the adapter is flush with a forward surface of the muzzle brake 10. In still other embodiments, the muzzle brake 10 may be received within the inner surface of the sleeve such that the rear wall of the adapter is forward of the rearward surface of the muzzle brake 10, but with the vent ports 14 of the muzzle brake 10 nonetheless received fully within the sleeve.

In the illustrated embodiment of FIG. 2, a chuck 44 is provided along the sleeve 32 to allow the adapter 30 to be secured to the muzzle brake 10 when the muzzle brake is fully received within the sleeve 32. In the illustrated embodiment, the chuck 44 includes a pair of through cutouts 46, 48 which are defined along the sleeve 32 on opposite circumferential sides of the centerline of the cylindrical inner surface 34. The cutouts 46, 48 each extend partially circumferentially around the sleeve 32 and partially along a longitudinal dimension of the sleeve, in circumferentially spaced-apart relationship to one another. For each cutout 46, 48, a corresponding arcuate movable segment member 50, 52 is provided which is sized and shaped to fit nicely within a corresponding cutout 46, 48. In the illustrated embodiment, each movable segment member 50, 52 is rotatably connected at a first end 54, 56 thereof to a corresponding first end 58, 60 of a respective cutout 46, 48. Thus, each movable segment member 50, 52 may be rotated between a first position, in which the movable segment member 50, 52 is received within and extends along the respective cutout 46, 48 (see FIG. 3), and a second position, in which each movable segment member 50, 52 is rotated outwardly from the respective cutout 46, 48 (see FIG. 2).

In the illustrated embodiment, the respective first ends 58, 60 of the cutouts 46, 48 are located circumferentially adjacent one another along the circumference of the sleeve 32. Thus, the respective first ends 54, 56 of the movable segment members 50, 52 are positioned relatively close to one another along the circumference of the sleeve 32, with each movable segment member 50, 52 extending from a first end thereof generally away from the first end of the other movable segment member 50, 52. In this way, the movable segment members may, in certain embodiments, be rotated from the above-discussed first position, in which the movable segment members 50, 52 are received within their respective cutouts 46, 48, to the second position, in which the movable segment members 50, 52 are rotated outwardly from their respective cutouts 46, 48, by positioning the sleeve 32 with the first ends 58, 60 of the cutouts 46, 48 and the associated first ends 54, 56 of the movable segment members 50, 52 generally downward, beneath the remainder of the sleeve 32, with the cutouts 46, 48 extending generally upward therefrom. In this position, the movable segment members 50, 52 may be allowed to "fall open," whereby gravity causes the movable segment members 50, 52 to rotate toward the second position. Likewise, the movable segment members 50, 52 may be rotated from the second position to the above-discussed first position by positioning the sleeve 32 with the first ends 58, 60 of the cutouts 46, 48 and the associated first ends 54, 56 of the movable segment members 50, 52 generally upward, above the remainder of the sleeve 32, and with the cutouts 46, 48 extending generally downward therefrom. In this position, the movable segment members 50, 52 may be allowed to "fall closed," whereby gravity causes the movable segment members 50, 52 to rotate to the first position.

In the illustrated embodiment of FIG. 3, each cutout 46, 48 is disposed along the sleeve 32 so as to overlie a portion of the at least one detent 28 or feature of the muzzle brake 10. Thus, when the muzzle brake 10 is received fully within the sleeve 32 and each movable segment member 50, 52 is rotated to the first position, an arcuate inner surface 62, 64 of the movable segment member 50, 52 overlies a portion of the at least one detent 28 or feature. In the illustrated embodiment of FIG. 2, each movable segment member inner surface 62, 64 defines corresponding protrusions and recesses such that the inner surface 62, 64 is shaped to conform to and mate with at least a portion of the at least one detent 28 or feature of the muzzle brake 10 when the movable segment member 50, 52 is in the first position. Thus, when the muzzle brake 10 is received fully within the sleeve 32 and each movable segment member 50, 52 is rotated to the first position, the movable segment members 50, 52 engage corresponding portions of the at least one detent 28 or feature of the muzzle brake 10 to "lock" the muzzle brake 10 in position within the sleeve 32.

In the illustrated embodiment, the outer surface 66 of the sleeve 32 defines a generally cylindrical shape. Portions of the outer surface 66 of the sleeve 32 located between the cutouts 46, 48, and respective outer arcuate surfaces of the movable segment members 68, 70, cooperate to define a series of threads 72. In the illustrated embodiment, a hollow, cylindrical collar 76 is provided having an inner surface 78 with a diameter substantially equal to, and only slightly larger than, the outer surface 66 of the sleeve 32. The inner surface 78 of the collar 76 defines inward-facing threads 80 which are complimentary to those threads 72 defined along the outer surface 66 of the sleeve 32 and the outer arcuate surfaces 68, 70 of the movable segment members 50, 52, such that, when the muzzle brake 10 is received fully within the sleeve 32 and each movable segment member 50, 52 is rotated to the first position, the collar 76 may be threadably received onto the outer arcuate surfaces 68, 70 of the movable segment members 50, 52 and the portions of the outer surface 66 of the sleeve 32 located between the cutouts 46, 48. When the collar 76 and movable segment members 50, 52 are engaged and tightened, the muzzle brake 10 is drawn into the body of the adapter 30 and pressed solidly against the forward inner lip 42 of the sleeve 32, thereby securing the movable segment members 50, 52 in engagement with the at least one detent 28 of the muzzle brake 10, and thereby further "locking" the muzzle brake 10 in position within the sleeve 32.

It will be recognized that additional configurations may be employed to allow the adapter 30 to be quickly positioned in place surrounding the above-discussed muzzle brake 10 and releasably "locked" in such position. For example, in various embodiments, the cutouts 46, 48 may be positioned along the body of the adapter 30 so as to extend along portions of the vent ports 14 of the muzzle brake 10 when the muzzle brake 10 is received within the sleeve 32. In such embodiments, in addition to, or in the alternative to, the inner surfaces of the movable segment members 50, 52 being shaped to conform to the at least one detent 28, the inner surfaces of the movable segment members 50, 52 may further be shaped to conform to and extend into portions of the underlying vent ports 14. In this way, when the muzzle brake 10 is received within the sleeve 32 and the movable segment members 50, 52 are rotated fully into the cutouts 46, 48 to "lock" the adapter 30 in relation to the muzzle brake 10, the movable segment members 50, 52 cooperate with the sleeve 32 to overly and cover the vent ports 14 of the muzzle brake 10. In still other embodiments, the cutouts 46, 48 and associated movable segment members 50, 52 overlie at least a portion of the vent ports 14 of the muzzle brake 10, but do not overlie the detents 28. Thus, in such embodiments, the vent ports themselves may form the "feature" of the muzzle brake 10 which the movable segment members 50, 52 engage when the muzzle brake 10 is received within the sleeve 32 and the movable segment members 50, 52 are rotated fully into the cutouts 46, 48 to "lock" the adapter 30 in relation to the muzzle brake 10.

In the illustrated embodiment, a central portion of the outer surface 66 of the sleeve 32 defines a cylindrical diameter slightly less than the outer diameter of the rearward portion of the sleeve 32, such that a circumferential annular lip 74 is formed between the rearward portion and the central portion. In this embodiment, the collar 76 is configured to be positioned in telescopic relationship with the central portion of the outer surface 66. More specifically, as the collar 76 is threadably received onto the outwardly facing threads 72 of the movable segment members 50, 52, the collar 76 is linearly translated along an axial dimension of the sleeve 32 in a rearward direction to overlie the rearward portion of the outer surface 66, thereby receiving the threaded movable segment members 50, 52; locking the movable segment members 50, 52 in engagement with the at least one detent 28 or rearward facing feature of the muzzle brake 10; and locking the muzzle brake 10 in position within the sleeve 32. Conversely, as the collar is at least partially threadably withdrawn from the outwardly facing threads 72 defined by the movable segment members 50, 52, the collar 76 is linearly translated along an axial dimension of the sleeve 32 in a forward direction to at least partially overlie the central portion of the outer surface 66. In the illustrated embodiment, a forward end of the collar 76 defines an inwardly facing annular lip 82 that is sized and shaped to conform to and engage the lip 74 defined between the rearward portion and the central portion of the outer surface 66 when the collar 76 is fully threadably received onto the outwardly facing threads 72 defined by the movable segment members 50, 52. Thus, when the collar 76 is fully threaded onto the outwardly facing threads 72 defined by the movable segment members 50, 52, the engaged and conforming lips 74, 82 establish a frictional connection to further secure the collar 76 in threaded engagement with the outwardly facing threads 72 of the sleeve 32.

Figure 4:
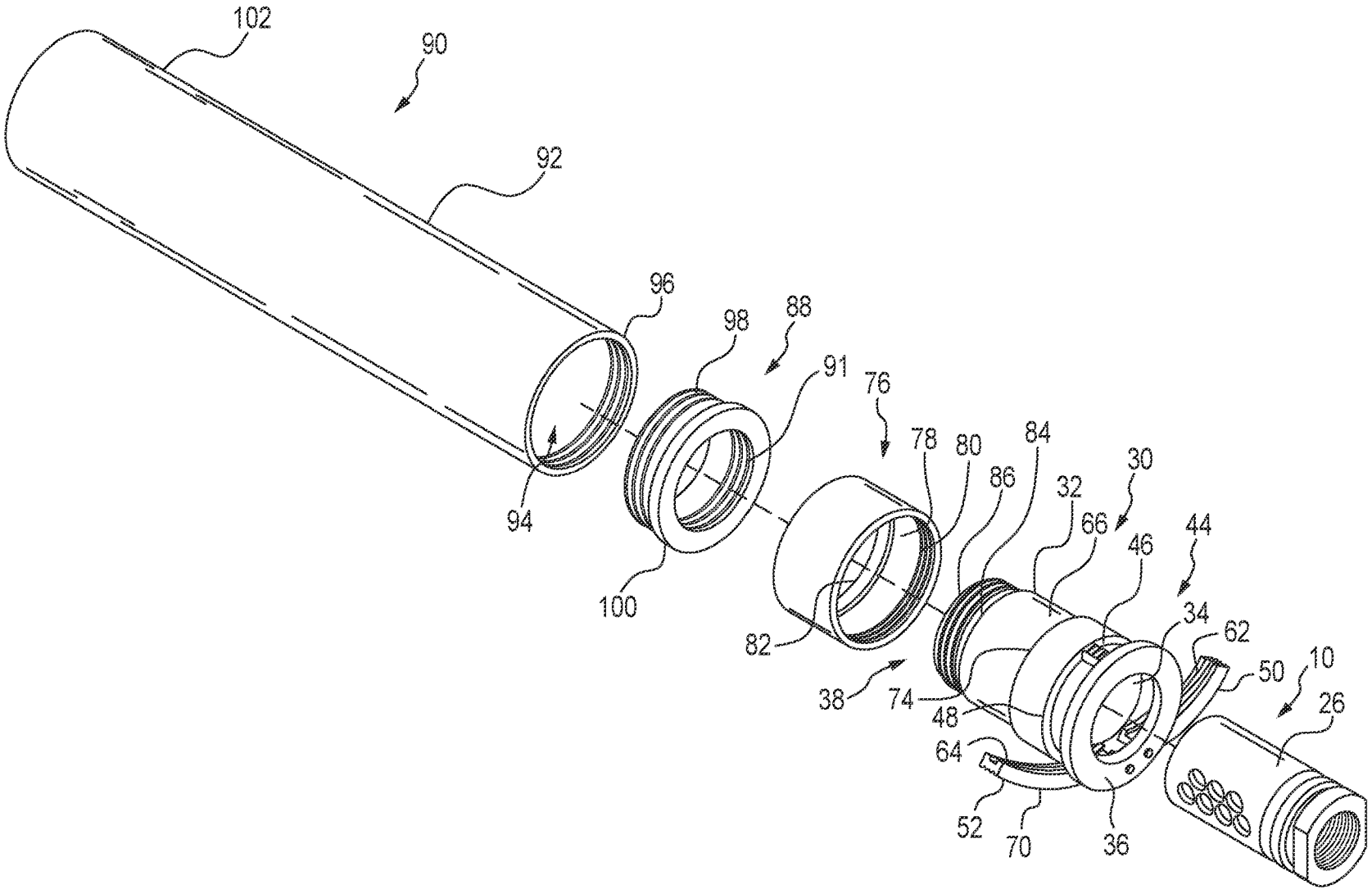
FIG. 4 is an exploded perspective view of the muzzle brake of FIG. 1 and the adapter of FIG. 3, together with a muzzle accessory constructed in accordance with several additional features of the present general inventive concept.

With further reference to FIG. 4, in the illustrated embodiment, a suppressor 90 is provided which is constructed and configured to be mounted to the adapter 30. More specifically, in the illustrated embodiment, a forward portion of the outer surface 66 of the sleeve 32 defines a cylindrical diameter slightly less than the diameter of the central portion of the sleeve 32, such that a second circumferential annular lip 84 is formed between the forward portion and the central portion. In the illustrated embodiment, the forward portion of the outer surface 66 defines an outwardly facing threaded surface 86. A threaded coupler 88 is provided consisting of a substantially cylindrical hollow member having an interior threaded surface 91 which is sized and shaped to be threadably received onto the forward portion of the outer surface 66 of the sleeve 32. The second lip 84 of the sleeve 32 is configured to serve as a "stop" for limiting threadable receipt of the coupler 88 onto the forward portion of the outer surface 66. Stated differently, the coupler 88 may be threaded onto the forward portion of the outer surface 66 until it contacts and engages the second lip 84, whereupon a frictional connection between the coupler 88 and the second lip 84 may be formed, thereby securing the coupler 88 in threaded engagement surrounding the forward portion of the outer surface 66.

In the embodiment shown in FIG. 4, the suppressor 90 includes a substantially cylindrical housing 92 defining a cylindrical inner chamber 94 having an open rearward end 96 and an inner diameter substantially equal to, and only slightly larger than, the diameter of an outer cylindrical surface 98 of the coupler 88. The outer surface 98 of the coupler 88 and the rearward portion of the inner chamber 94 each define complimentary threaded surfaces, such that the rearward end 96 of the housing 92 may be threadably received onto the outer surface 98 of the coupler 88. A rearward end of the coupler 88 defines a radially outwardly protruding lip 100, such that when the rearward end 96 of the housing 92 is fully threadably received onto the outer surface 98 of the coupler 88, the lip 100 may contact and frictionally engage the rearward end 96 of the housing 92 to secure the housing 92 in threaded engagement with the coupler 88.

Figure 7:
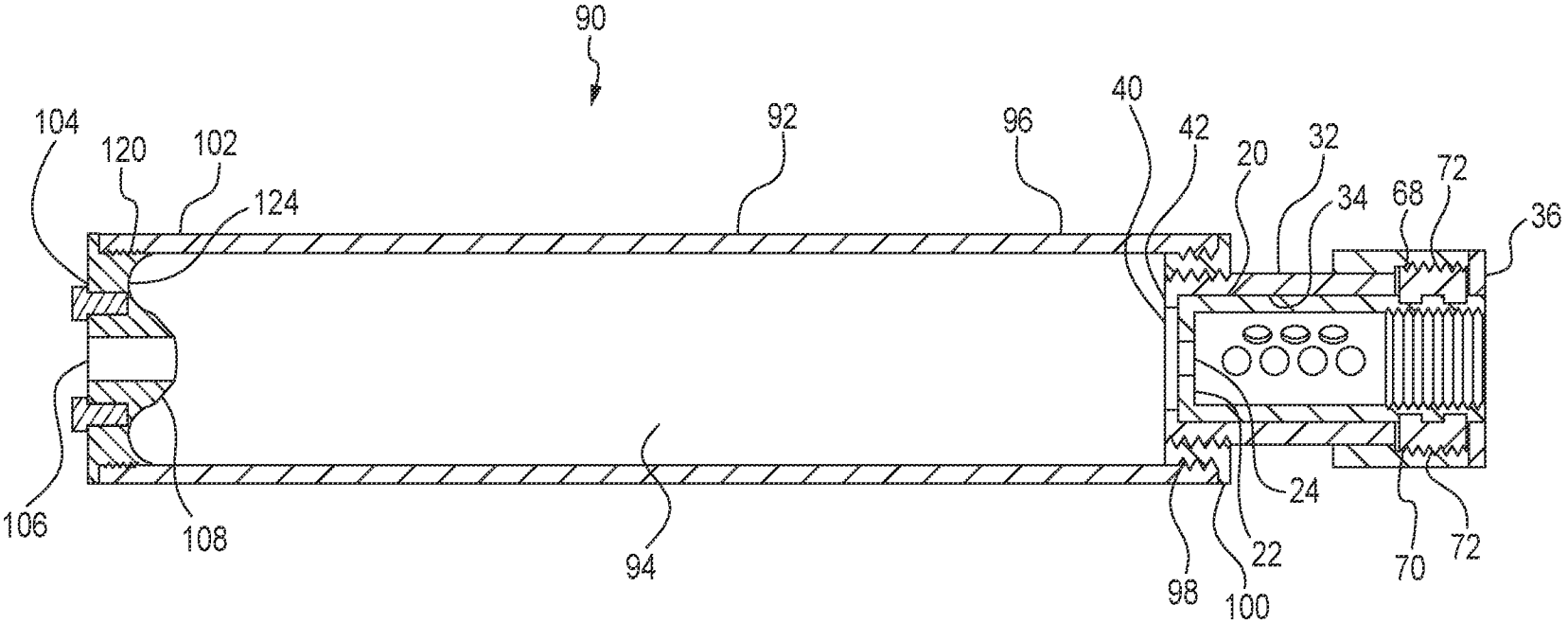
FIG. 7 is a cross-sectional side view of the muzzle brake, adapter, and muzzle accessory of FIG. 3.

FIG. 7 illustrates a cross-sectional side view of the Griffitts muzzle brake 10 illustrated in FIGS. 1 and 2, with the adapter 30 and sound suppressor 90 installed on the muzzle brake 10. As shown in FIG. 7, a forward end 102 of the housing 92 defines an open cylindrical end of the housing 92. However, the forward end 102 of the housing 92 has removably secured therein a forward annular wall 104 defining a through bore 106 extending therethrough in alignment coaxially with a longitudinal centerline of the cylindrical inner chamber 94 of the housing 92.

Figure 6:
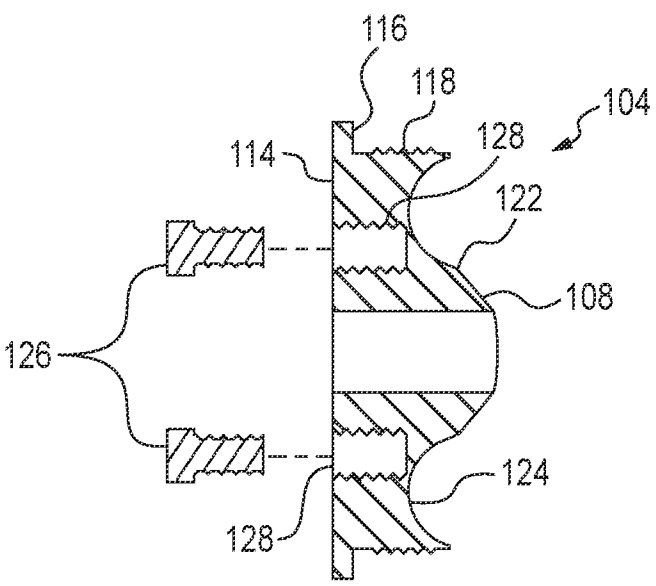
FIG. 6 is a cross-sectional side view of the removable forward wall portion of FIG. 5.
Figure 5:
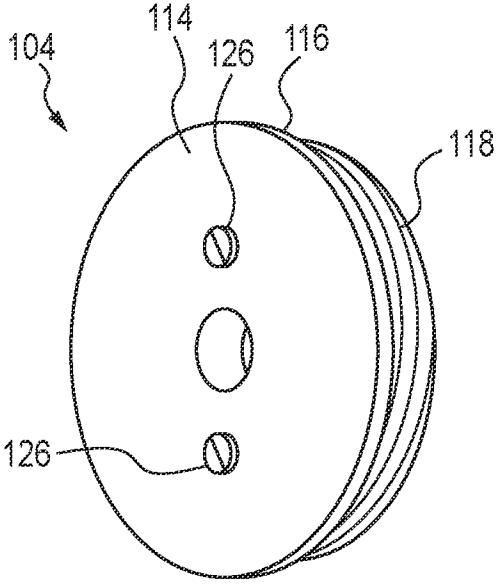
FIG. 5 is a perspective view of a removable forward wall portion of the muzzle accessory of FIG. 4.

FIGS. 5 and 6 illustrate one embodiment of a forward wall 104 constructed in accordance with several additional features of the present general inventive concept. With reference to FIGS. 5 and 6, the forward wall 104 defines generally a forward annular surface 114 having an outwardly extending annular lip 116 projecting radially outwardly along the perimeter of the forward surface 114. The outer perimeter of the annular lip 116 is generally sized and shaped to conform to the outer circumference of the cylindrical housing 92. Rearward of the annular lip 116, the forward wall 104 defines an outer cylindrical surface having a diameter slightly smaller than that of the annular lip 116. More specifically, the outer cylindrical surface 118 of the forward wall 104 defines outwardly facing threads which are sized and shaped to threadably mate with matching inward threads 120 defined along an inner annular portion of the forward end 102 of the housing 92. Thus, as shown in FIG. 7, the forward wall 104 may be threadably received and secured, as by a frictional connection or other suitable connection, within the forward end 102 of the housing 92 to partially close the forward end 102 of the housing 92.

With further reference to FIGS. 5 and 6, the through bore 106 defined by the forward wall 104 is of a diameter sized to conform to, and is only slightly larger than, the caliber of a projectile to be fired from the muzzle of the firearm with which the muzzle brake 10 and the suppressor 90 may be used. In the illustrated embodiment, a rearward surface 122 of the forward wall 104 defines a truncated, conical deflector portion 108 encircling and extending outwardly from an inward end of the through bore 106. In the illustrated embodiment, the deflector portion 108 defines a truncated conical rear wall surface which begins along the perimeter of the through bore 106 and extends radially outwardly and axially forwardly from the edges of the through bore 106. Radially outward from the truncated conical deflector portion 108, the rear surface 122 of the forward wall 104 defines an annular concave trough 124. The trough 124 extends along an annular path along the outer circumference of the truncated conical deflector portion 108. The surface of the trough 124 extends generally radially outward and forward from the rear, inward end of the through bore 106, before curving radially outwardly and extending rearwardly to meet a rearward circumferential edge of the outer cylindrical surface 118 of the forward wall 104. Thus, when the forward wall 104 is secured within the forward end 102 of the housing 92, the outer circumference of the trough 124 is positioned adjacent the inner wall 94 of the inner surface 92.

In various embodiments, one or more engagement fixtures is provided along the forward surface 114 of the forward wall 104 to allow the forward wall 104 to be easily grasped or otherwise engaged, thereby enabling convenient threaded removal of the forward wall 104 from the forward end 102 of the housing 92. For example, in the illustrated embodiment, a pair of dogs 126 are provided, extending outwardly from the forward surface 114 on opposite sides of the through bore 106. In the illustrated embodiment, the dogs 126 are provided by way of a pair of small bolts, with each bolt being threadably received within one of oppositely disposed, interiorly-threaded blind bores 128 formed on opposite sides of the through bore 106. The blind bores 128 are each sized and shaped to receive the shaft portion of a respective bolt, such that a head portion of the bolt extends outwardly from the forward surface 114 when the bolt is fully received within its respective blind bore 128. However, those skilled in the art will recognize numerous ways and appropriate devices which may be used to accomplish provision of one or more dogs 126 along or near the forward surface 114 of the forward wall 104, and such devices may be used without departing from the spirit and scope of the present general inventive concept. For example, in other embodiments, the dogs 126 may be integrally formed with the forward surface 114 of the forward wall 104. Furthermore, those skilled in the art will recognize numerous additional features which may be used to allow engagement of the forward wall 104 for threadable rotation into and out of the forward end 102 of the housing 92, and such additional features and devices may be used without departing from the spirit and scope of the present general inventive concept. For example, in various other embodiments, one or more recesses, protuberances, or other textural features may be provided to allow gripping and/or tool engagement with the forward wall 104.

As shown in FIG. 7, when the muzzle break 10 is received within the sleeve 32 of the adapter 30, the inner surface 34 of the sleeve 34 conforms closely to the outer surface 26 of the muzzle brake 10 and serves to limit air flow from the interior of the gas capture chamber 12 through the vent ports 14. Thus, when the adapter 30 is secured onto the muzzle break 10 as discussed above, the adapter 30 effectively blocks the vent ports 14 and causes the muzzle break 10 to cease functioning to counteract the forces of recoil of the firearm. Instead, once the sound suppressor 90 is then secured to the adapter 30 via the coupler 88, the muzzle break 10 itself serves as a first "expansion chamber" of the sound suppressor 90, with the forward annular wall 22 of the muzzle break 10 acting as a first "deflector" to capture and limit at least a portion of expanding gas exiting the muzzle of the firearm.

Stated differently, and with reference to FIG. 7, as a projectile is fired from the firearm, the projectile travels down the barrel of the firearm and exits the muzzle into the muzzle brake 10. Thereafter, the projectile continues along the coaxial centerline of the barrel and the muzzle brake 10, passing in close conformity through the through bore 24 of the forward annular wall 22. As the projectile exits the muzzle and begins to pass through the muzzle brake 10, expanding gas from the muzzle is permitted to enter and expand into the gas capture chamber 12 of the muzzle brake 10. However, rather than the expanding gas exiting the muzzle brake 10 through the vent ports 14, the adapter 30 prohibits the expanding gas from exiting the vent ports 14, thus forcing the expanding gas to exit the muzzle brake through the through bore 24 of the forward annular wall 22. This expansion of the gas within the muzzle brake 10, followed by redirection of the expanding gas through the through bore 24 of the forward annular wall 22, results in dissipation of at least a portion of the kinetic energy of the expanding gas, thereby reducing the acoustic intensity of the firearm report resulting from firing the projectile.

With further reference to FIG. 7, upon exiting the muzzle brake through the through bore 24 of the forward annular wall 22, the projectile continues to travel through the suppressor 90 along the coaxial centerline of the barrel, the muzzle brake 10, and the inner chamber 94 of the housing 92 before exiting the forward annular wall 104 of the suppressor 90. The projectile thus passes in close conformity through the through bore 106 of the forward annular wall 104 of the suppressor 90. As the projectile exits the muzzle brake 10 into the housing 92, the expanding gas enters the inner chamber 94 of the housing 92, where it is permitted to further expand and dissipate additional kinetic energy. Upon reaching the forward wall 104, the gas is forced to exit the inner chamber 94 of the suppressor 90 through the through bore 106 of the forward annular wall 104.

In various embodiments, each suppressor 90 may be provided with a plurality of interchangeable forward walls 104, with each wall having a central through bore 106 defining a diameter sized to conform to a different caliber of a projectile. For example, in various embodiments, a suppressor 90 may be provided with a first forward wall 104*a* defining, for example, a through bore 106*a* conforming to, and only slightly larger than, a nine millimeter caliber size. A second forward wall 104*b* may be provided having a through bore 106*b* conforming to a thirty-eight caliber size. A third forward wall 104*c* may be provided having a through bore 106*c* conforming to a forty-five caliber size. A fourth forward wall 104*d* may be provided having a through bore 106*d* conforming to a twenty-two caliber size, and so on. In embodiments such as these, each suppressor may be reconfigured for operation with any of the various caliber projectiles for which a forward wall 104 having a through bore 106 matching that projectile caliber is provided, by threadably removing the existing forward wall 104 and threadably fastening into the forward end 102 of the housing 92 a forward wall 104 having a through bore 106 matching the desired caliber.

In operation of the embodiment of FIG. 7, a firearm may be initially configured for use with a muzzle brake 10 having similar outward features to that of the Griffitts muzzle brake. In such configuration, the muzzle brake 10 may be installed on a distal end of the barrel of the firearm, with the central axis of the barrel and the central axis of the muzzle brake 10 configured substantially coaxially. The firearm may be quickly configured for use with a muzzle accessory, such as the above-discussed suppressor 90, by providing an adapter 30 of the type described and illustrated in FIGS. 3, 4, and 7, having installed thereon the collar 76, the coupler 88, and the desired muzzle accessory. More specifically, to quickly install the muzzle accessory, the firearm may be positioned with the coaxial centerline of the barrel and the muzzle brake 10 extending generally non-vertically, and preferably with the barrel and muzzle brake 10 extending substantially horizontally. The adapter 30 may be configured such that the collar 76 is unthreaded from the outwardly facing threads 72 defined by the outward surfaces of the movable segment members 50, 52, and the collar 76 may be slid forward along the axial centerline of the sleeve 32 toward the muzzle accessory. In this configuration, the adapter 30 and muzzle accessory may be oriented in the first orientation discussed above, with the circumferentially adjacent ends of the cutouts 46, 48 positioned below the axial centerline of the adapter 30, such that the movable segment members 50, 52 are allowed to "fall open" outward from the cutouts 46, 48. The adapter 30 may then be brought into position over the muzzle brake 10, or the muzzle brake 10 may be brought within the adapter 30, such that the muzzle brake is received within the inner surface 34 of the sleeve 32. Thereafter, the adapter 30 and muzzle accessory may be rotated about the central axis thereof toward the second orientation discussed above, with the circumferentially adjacent ends of the cutouts 46, 48 positioned above the axial centerline of the adapter 30, such that the movable segment members 50, 52 are allowed to "fall closed" into the cutouts 46, 48. Thereafter, the collar 76 may be threadably received onto the outwardly facing threads 72 defined by the outward surfaces of the movable segment members 50, 52, thereby "locking" the adapter 30 and muzzle accessory onto the muzzle brake 10.

In a separate operation, the muzzle accessory 90 may be configured and/or reconfigured for use with a desired caliber of projectile matching the muzzle brake 10 on which the accessory is installed, or on which the accessory is intended to be installed. In one embodiment, such configuration may be accomplished by selecting a forward wall 104 having a through opening 106 sized to conform to the caliber of the muzzle brake 10 and/or associated firearm. The selected forward wall 104 may then be secured within the forward end 102 of the housing 92 by suitable fasteners, such as for example the above-described threaded connection. In other embodiments, the muzzle accessory may be reconfigured by removing an existing forward wall 104, and thereafter by securing a newly selected forward wall 104 having a through opening 106 sized to conform to the caliber of the muzzle brake 10 and/or associated firearm. In both such operations, the above-described engagement fixtures may be engaged by hand or by a suitable tool to assist in removal and/or reinstallation of the various forward walls 104.

In the above-described configuration with the adapter 30 and muzzle accessory "locked" onto the muzzle brake 10, the muzzle brake 10 is effectively disabled, and the firearm is configured for use with the muzzle accessory installed on the adapter 30. In this configuration, the firearm may be quickly re-configured for use with the muzzle brake 10 by decoupling the collar 76 from the threads 72 defined by the outward surfaces of the movable segment members 50, 52, sliding the collar 76 forward along the axial centerline of the sleeve 32 toward the muzzle accessory to expose the movable segment members 50, 52, and rotating the adapter 30 and muzzle accessory about the central axis thereof toward the second orientation discussed above, with the circumferentially adjacent ends of the cutouts 46, 48 positioned above the axial centerline of the adapter 30, such that the movable segment members 50, 52 are allowed to "fall open" into the cutouts 46, 48. Thereafter, the adapter 30 and muzzle accessory may be separated from the muzzle brake 10, whereupon the muzzle brake is re-enabled for use with the firearm.

From the foregoing description, one of skill in the art will recognize that the above-described example embodiments provide a sound suppressor or other muzzle accessory with an adapter configured to secure the sound suppressor or other muzzle accessory to another muzzle accessory that is installed on the muzzle of a firearm, such that the sound suppressor incorporates and converts the muzzle accessory in order to assist the sound suppressor in suppressing firearm report resulting from discharge of the firearm. While, in the above-discussed example embodiments, the muzzle accessory installed on the firearm is described in the context of a muzzle break, it is not the intention of the applicant to restrict or in any way limit the scope of the general inventive concept to use with a muzzle break. For example, in other embodiments, the adapter 30 may define an inner surface which is 34 shaped to fit and secure to any of a wide variety of muzzle accessories, such as for example flash suppressors, muzzle brakes, compensators, other sound suppressors, etc. Furthermore, while the above-described example embodiments describe a sound suppressor configured to be secured to a muzzle accessory via the adapter and coupler, it is not the intention of the applicant to restrict or in any way limit the scope of the general inventive concept to specific use of the adapter and coupler for purposes of securing a sound suppressor to the muzzle accessory. In this regard, in other embodiments, the adapter 30 and coupler 88 may be used to secure a different type of muzzle accessory, such as for example a flash suppressor, muzzle brake, compensator, etc., to the muzzle accessory that is installed on the muzzle of the firearm.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment. Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

Having thus described the aforementioned invention, what is claimed is:

1. A system for installing a sound suppressor on one of a plurality of firearms, each firearm having a muzzle accessory mounted thereto and each firearm being of a different projectile caliber, the system comprising:

an adapter configured to attach to the muzzle accessory; and a sound suppressor configured to attach to the adapter, the sound suppressor comprising:

an outer housing having a cylindrical interior and an open forward end; and a plurality of forward walls removably securable to the forward end of the housing and interchangeable with one another, each of the forward walls defining a through bore positioned along the forward wall to align with a central axis of each of the muzzles of the firearms when the forward wall is secured to the housing, each through bore conforming to the caliber of one of the firearms;

wherein each forward wall defines a rearward surface configured to face an interior of the outer housing, each rearward surface defining a truncated conical deflector portion annularly surrounding the respective through bore of the respective forward wall and extending radially forward from a perimeter of the the respective through bore, each rearward surface further defining an annular concave trough encircling the respective truncated conical deflector portion and through bore of the forward wall, each annular concave trough defining a first surface portion that curves radially outward and forward from a respective radially outward perimeter of the respective truncated conical deflector portion and a second surface portion that curves radially outward and rearward from a respective radially outward perimeter of the respective first surface portion wherein when one of the plurality of forward walls is secured to the forward end of the housing, the interior of the housing between the secured one of the plurality of walls and the adapter consists of a cylindrical surface.

2. The system of claim 1 further comprising a coupler configured to attach to the adapter, the sound suppressor configured to attach to the coupler.

3. The system of claim 1, wherein the adapter is configured to limit air flow within the muzzle accessory to between a projectile intake and a projectile outlet of the muzzle accessory, whereby the muzzle accessory functions as an expansion chamber for gas exiting the muzzle.

4. The system of claim 1, wherein the adapter comprises a sleeve configured to surround at least a portion of the muzzle accessory.

5. The system of claim 4, wherein the adapter further comprises a chuck configured to engage the muzzle accessory to secure the adapter to the muzzle accessory when the muzzle accessory is received within the sleeve.

6. The system of claim 5, the chuck comprising at least one cutout defined along the sleeve, and at least one movable segment member removably received within the at least one cutout.

7. The system of claim 6, wherein the at least one movable segment member defines a surface configured to mate with and engage at least a portion of at least one feature of the muzzle accessory.

8. The system of claim 7, wherein the at least one movable segment member is rotatably secured to the sleeve within the at least one cutout.

9. The system of claim 7, the chuck further comprising a fastener for securing the at least one movable segment member within the at least one cutout.

10. The system of claim 9, wherein the fastener is a threaded fastener.

11. The system of claim 10, wherein the fastener establishes an engagement with the at least one movable segment member and a frictional engagement with the sleeve.

12. The system of claim 1, wherein each forward wall defines a threaded outer surface adapted to threadably mate with an inner surface of the outer housing and at least one protuberance configured to be engaged for rotating the forward wall into and out of threadable engagement with the housing inner surface.

13. The system of claim 12, each protuberance being defined by a removable bolt positioned along a forward surface of the forward wall.

14. The system of claim 1, wherein the plurality of forward walls include forward walls having through openings conforming to each of a plurality of calibers.

15. The system of claim 1, wherein when the adapter is attached to the muzzle accessory and the sound suppressor is attached to the adapter with one of the forward walls secured to the outer housing, the outer housing defines a smooth and unobstructed cylindrical cavity from a forward end of the muzzle accessory to a rearward end of the secured forward wall.

* * * * *